US009302530B2

(12) United States Patent
Fukumoto et al.

(10) Patent No.: US 9,302,530 B2
(45) Date of Patent: Apr. 5, 2016

(54) CAP FOR WRITING INSTRUMENT AND WRITING INSTRUMENT

(75) Inventors: Takeo Fukumoto, Yokohama (JP); Syuuhei Hoshino, Yokohama (JP)

(73) Assignee: Mitsubishi Pencil Company, Limited, Tokyo (JP)

( * ) Notice: Subject to any disclaimer, the term of this patent is extended or adjusted under 35 U.S.C. 154(b) by 0 days.

(21) Appl. No.: 14/405,497

(22) PCT Filed: Jun. 5, 2012

(86) PCT No.: PCT/JP2012/064476

§ 371 (c)(1), (2), (4) Date: Dec. 4, 2014

(87) PCT Pub. No.: WO2013/183119

PCT Pub. Date: Dec. 12, 2013

(65) Prior Publication Data

US 2015/0183260 A1 Jul. 2, 2015

(51) Int. Cl.

| | |
|---|---|
| ***B43K 23/12*** | (2006.01) |
| ***B43K 7/10*** | (2006.01) |
| ***B43K 25/02*** | (2006.01) |
| ***B43K 8/00*** | (2006.01) |
| ***B43K 8/02*** | (2006.01) |
| ***B43K 8/04*** | (2006.01) |
| ***B43K 7/00*** | (2006.01) |

(52) U.S. Cl.

CPC ..... *B43K 23/124* (2013.01); *B43K 7/005* (2013.01); *B43K 7/10* (2013.01); *B43K 8/003* (2013.01); *B43K 8/024* (2013.01); *B43K 8/04* (2013.01); *B43K 23/12* (2013.01); *B43K 23/126* (2013.01); *B43K 25/022* (2013.01)

(58) Field of Classification Search

CPC combination set(s) only.
See application file for complete search history.

(56) References Cited

U.S. PATENT DOCUMENTS

| | | | | | |
|---|---|---|---|---|---|
| 5,127,754 | A * | 7/1992 | Mase | B43K 23/124 401/202 |
| 5,927,887 | A * | 7/1999 | Ishikawa | B43K 23/124 401/202 |
| 5,975,783 | A * | 11/1999 | Hu | B43K 23/128 401/202 |
| 6,974,272 | B2 * | 12/2005 | Furukawa et al. | B43K 23/126 401/243 |

FOREIGN PATENT DOCUMENTS

| | | | |
|---|---|---|---|
| JP | 56-133491 | U | 10/1981 |
| JP | 09-169196 | A | 6/1997 |
| JP | 09-263089 | A | 10/1997 |
| JP | 11-221997 | A | 8/1999 |
| JP | 2002-240483 | A | 8/2002 |
| JP | 2009-214515 | A | 9/2009 |
| JP | 2010-247405 | A | 11/2010 |

* cited by examiner

*Primary Examiner* — David Walczak
(74) *Attorney, Agent, or Firm* — Foley & Lardner LLP

(57) ABSTRACT

A writing implement (1) wherein the outer circumferential surface of a crown outer cylindrical section (21) fits into the inner circumferential surface of a case (11) and the inner circumferential surface of a crown inner cylindrical section (22) fits into the outer circumferential surface of an attachment body (12). In addition, an annular space (27) is formed in the crown (5), between the inner circumferential surface of the crown outer cylindrical section (21) and the outer circumferential surface of the crown inner cylindrical section (22). Air will flow through the annular space (27) even if, for example, the cap (2) becomes stuck in the bronchial tubes of an infant as a result of being accidentally swallowed by the infant. Suffocation accidents can, therefore, be reliably prevented.

9 Claims, 15 Drawing Sheets

CAP FOR WRITING INSTRUMENT AND WRITING INSTRUMENT

CROSS-REFERENCE TO RELATED APPLICATIONS

This application is a National Stage application of PCT/JP2012/064476, filed Jun. 5, 2012.

TECHNICAL FIELD

The present invention relates to a cap for a writing instrument and to a writing instrument.

BACKGROUND ART

For example, at the front end of a cap body or the back end of a writing instrument body, an endcap which has a function as decoration of the writing instrument or a function as a pedestal for a clip is attached (Japanese Patent Publication No. 2009-214515A, Japanese Patent Publication No. 2010-247405A, and Japanese Patent Publication No. 11-221997A). For example, in Japanese Patent Publication No. 2009-214515A, an endcap is attached to a projection which is arranged in a restricting wall part which is formed at a top end of a cylinder. In attachment, an inside circumferential surface of a mounting hole of the endcap is fit with an outside circumferential surface of the projection. The endcap is attached to the cylinder by a predetermined mounting strength in this way.

SUMMARY OF INVENTION

In general, the overall length of a writing instrument is determined as a predetermined size. The front end of the writing instrument body enters into the cap, so to avoid interference with the writing instrument body, the length by which the endcap enters the cap body cannot be made that large. Furthermore, the above-mentioned endcap is attached to the projection by just the inside circumferential surface of the mounting hole. Further, the outside diameter of the writing instrument is also determined as a predetermined size, so it is not possible to increase the outside diameters of the cap body and the endcap for the purpose of increasing the contact area of the cap body and endcap. As a result, in the above-mentioned endcap, sufficient mounting strength cannot be secured. In addition, in Japanese Patent Publication No. 2009-214515A, an air passage to be formed for the purpose of preventing suffocation when for example the cap is mistakenly swallowed is not considered at all.

The present invention was made in consideration of the above situation and has as its object the provision of a cap for a writing instrument and of a writing instrument which enable a sufficient mounting strength of the endcap to be secured and enable an air passage for flow of air to be secured.

To achieve the above object, according to the present invention, there is provided a writing instrument which is provided with an endcap which is provided with an endcap outer cylinder and an endcap inner cylinder, an inside circumferential surface of the endcap outer cylinder being arranged separate from an outside circumferential surface of the endcap inner cylinder whereby a ring-shaped space is formed between the inside circumferential surface of the endcap outer cylinder and the outside circumferential surface of the endcap inner cylinder, and a body which is provided with a cylinder and a tubular mount which is formed inside of the cylinder and which is connected to the cylinder and which forms a holding space for holding the endcap between an inside circumferential surface of the cylinder and an outside circumferential surface of the mount, wherein the endcap is inserted into the holding space of the body, an outside circumferential surface of the endcap outer cylinder and the inside circumferential surface of the cylinder are fit together, and an inside circumferential surface of the endcap inner cylinder and the outside circumferential surface of the mount are fit together, whereby the endcap is fastened to the body and air can flow between an inside of the body and an outside of the endcap through the ring-shaped space which is formed between the inside circumferential surface of the endcap outer cylinder and the outside circumferential surface of the endcap inner cylinder.

According to such a writing instrument, the endcap is fastened to the body by the outside circumferential surface of the endcap outer cylinder and the inside circumferential surface of the endcap inner cylinder being respectively fit together with the inside circumferential surface of the cylinder and the outside circumferential surface of the mount. As a result, even without setting the total length or outside diameter of the writing instrument large, for example, the endcap can be fastened to the body by a sufficient mounting strength compared with the case where it is fastened to the body by only the inside circumferential surface of the endcap inner cylinder. Further, the ring-shaped space which is formed between the inside circumferential surface of the endcap outer cylinder and the outside circumferential surface of the endcap inner cylinder establishes an air passage. As a result, air can flow through this air passage between the inside of the body and the outside of the endcap. Occurrence of accidents involving suffocation can therefore be reliably prevented.

In the writing instrument according to the present invention, the mount sticks out to the outside from the outside end of the endcap inner cylinder. By such a constitution, it is possible to give a decorative feature to the writing instrument by exposure of the mount to the outside. Further, a user can visually confirm the mount from outside. For example, by setting the color of the mount and the color type of the writing instrument the same, a user can simply confirm the color type of the writing instrument. Further, when the endcap is integrally formed with a clip of the same color type as the color type of the writing instrument, the user can confirm the color type of the writing instrument by the clip as well.

Further, the writing instrument according to the present invention is further provided with a cutaway part which is formed at an inside end of the endcap outer cylinder and forms an air passage between the inside circumferential surface of the cylinder and the outside circumferential surface of the mount. According to such a constitution, the inside end of the endcap outer cylinder can greatly enter the inside of the cylinder at the outside of the cutaway part. The total length and outside diameter of the writing instrument are restricted to predetermined sizes, so the space inside of the cylinder can be effectively used. Further, the outside circumferential surface of the endcap outer cylinder can contact the inside circumferential surface of the cylinder over a large area. In the endcap, a further large mounting strength is secured.

Further, in the writing instrument according to the present invention, the body is provided with a cap body which has the cylinder and the mount and a writing instrument is attached to the cylinder.

Further, according to the present invention, there is provided a cap for a writing instrument provided with an endcap which is provided with an endcap outer cylinder and an endcap inner cylinder, an inside circumferential surface of the endcap outer cylinder being arranged separate from an outside circumferential surface of the endcap inner cylinder, whereby a ring-shaped space is formed between the inside circumferential surface of the endcap outer cylinder and the outside circumferential surface of the endcap inner cylinder, and a cap body which is provided with a cylinder and a tubular mount which is formed inside of the cylinder and which is connected to the cylinder and which forms a holding space for holding the endcap between an inside circumferential surface of the cylinder and an outside circumferential surface of the mount, wherein the endcap is inserted into the holding space of the cap body, an outside circumferential surface of the endcap outer cylinder and the inside circumferential surface of the cylinder are fit together, and an inside circumferential surface of the endcap inner cylinder and the outside circumferential surface of the mount are fit together, whereby the endcap is fastened to the cap body and air can circulate between an inside of the cap body and an outside of the endcap through the ring-shaped space which is formed between the inside circumferential surface of the endcap outer cylinder and the outside circumferential surface of the endcap inner cylinder.

According to the present invention, it is possible to provide a cap for a writing instrument and a writing instrument which enable sufficient mounting strength of the endcap to be secured and enable an air passage for flow of air to be secured even without setting the overall length or outside diameter of the writing instrument large. Further, the mount to which the endcap is attached is exposed to the outside, so it is possible to give a decorative feature to the writing instrument and possible for a user to simply confirm the color of the writing instrument from the outside.

Below, the present invention will be able to be further understood from the attached drawings and the description of the preferred embodiments of the present invention.

DESCRIPTION OF EMBODIMENTS

Below, referring to the attached drawings, embodiments of the present invention will be explained. Further, in the attached figures, the same or similar components are assigned the same reference notations.

First, referring to FIGS. 1 to 10, a first embodiment of the present invention will be explained.

Figure 1:
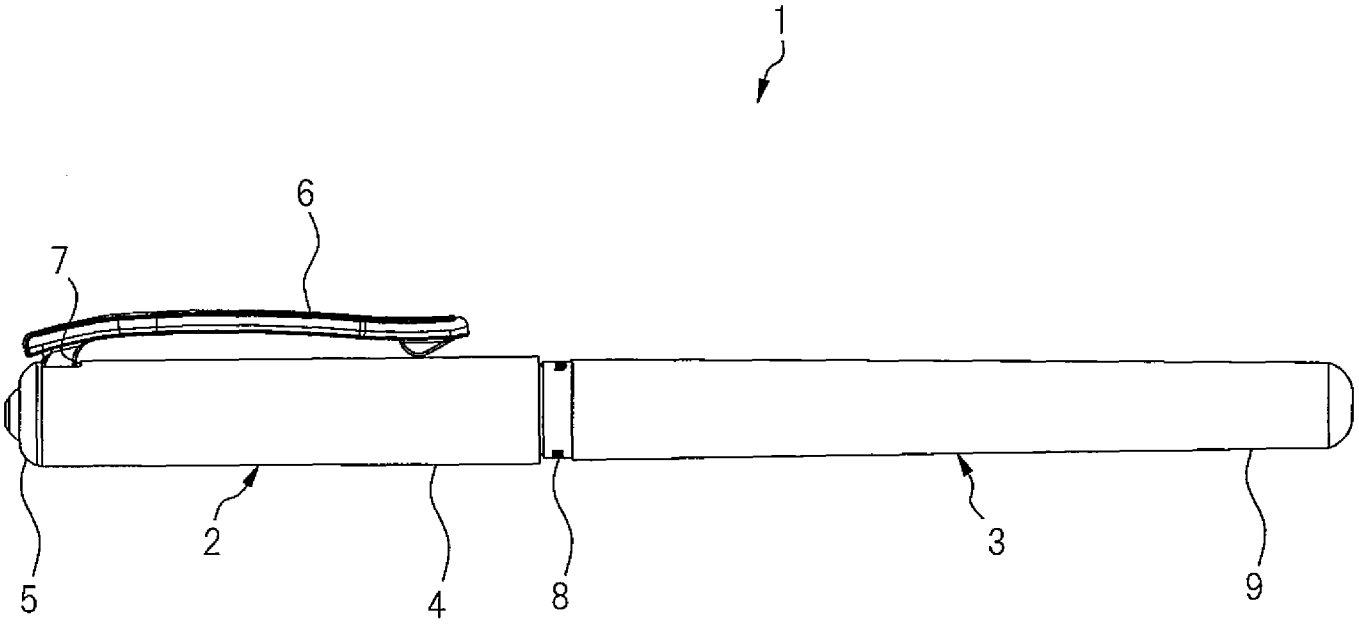
FIG. 1 is a side view which schematically shows the constitution of a writing instrument according to a first embodiment of the present invention.

FIG. 1 is a side view which schematically shows the constitution of a writing instrument 1 according to a first embodiment of the present invention. The writing instrument 1 is, for example, a water-based ink ball point pen. The writing instrument 1 is provided with a cap 2 and a writing instrument body 3 which is inserted from a back end of the cap 2 and is attached to the cap 2. The cap 2 is provided with a cap body 4 which receives a front end part of the writing instrument body 3 at its back end, an endcap 5 which is fastened by insertion into a front end of the cap body 4, and a clip 6 which is integrally formed with the endcap 5. The clip 6 passes through the cutaway part 7 which is formed at the front end of the cap body 4 and sticks out to outside of the cap body 4. The endcap 5 has a function as decoration of the writing instrument 1 and a function as a pedestal of the clip 6. Note that, in this Description, the front end of the writing instrument body 3, that is, the front side of the pen, is defined as the "front" side of the writing instrument body 3 while the side opposite to the front of the pen of the writing instrument body 3 along the axial center of the writing instrument body 3 is defined as the "back" side of the writing instrument body 3.

Figure 2:
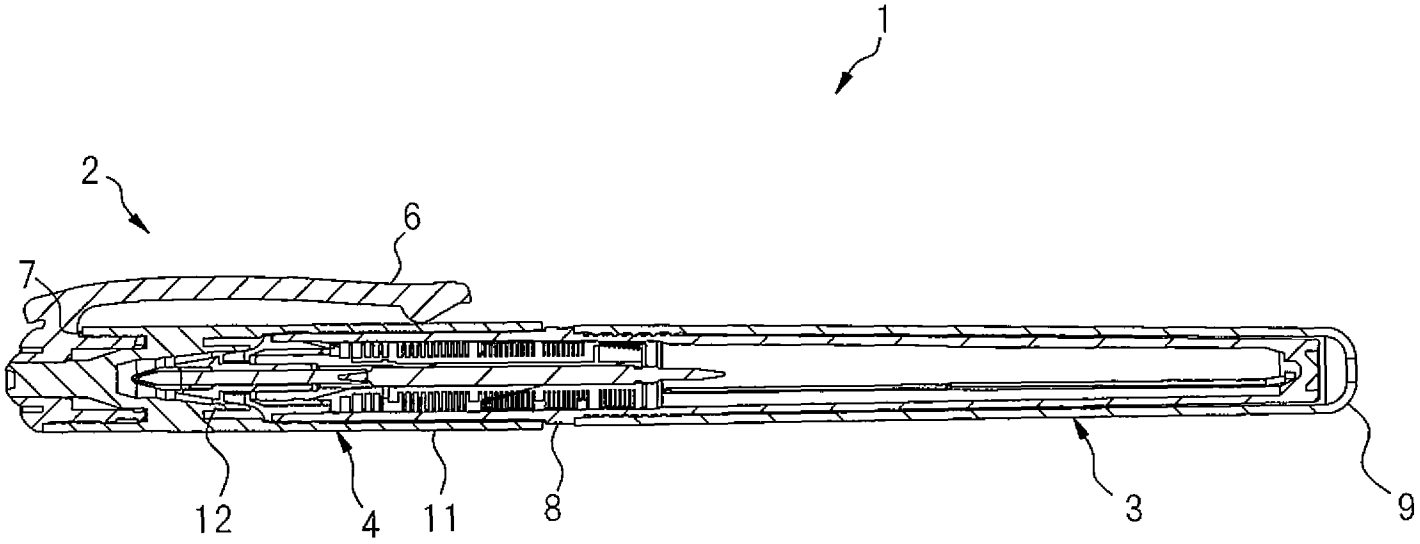
FIG. 2 is a vertical cross-sectional view which schematically shows the constitution of a writing instrument according to a first embodiment of the present invention.

FIG. 2 is a vertical cross-sectional view along an imaginary plane which includes the axial center of the writing instrument 1. Referring to FIG. 2 as well, the writing instrument body 3 is provided with a refill 8 which holds ink and has a tip at its front end and a back shaft 9 which receives a back end part of the refill 8 and is attached to the refill 8. The refill 8 is filled with a water-based ink. On the other hand, the cap body 4 of the cap 2 is provided with a round tubular shaped cylinder 11 and a mount 12 which is arranged inside of the cylinder 11 and is connected to the cylinder 11. The cylinder 11 and the mount 12 are arranged coaxially with each other. The cylinder 11 receives the front end part of the refill 8 at its back end and receives the endcap 5 at its front end. Note that, in this Description, the side where the endcap 5 is attached is defined as the "front" side of the cap body 4, while the side where the writing instrument body 3 is inserted is defined as the "back" side of the cap body 4.

The refill 8 and back shaft 9 which form the writing instrument body 3, the cylinder 11 and mount 12 which form the cap body 4, and the endcap 5 and clip 6 are respectively, for example, formed from polycarbonate (PC), acrylonitrile butadiene styrene (ABS), polypropylene (PP), polyacetal (POM), acryl, polyethylene terephthalate (PET), polyethylene (PE), or another resin material. Further, the cylinder 11 and mount 12 are formed by one-piece molding. Similarly, the endcap 5 and clip 6 are formed by one-piece molding.

Figure 3:
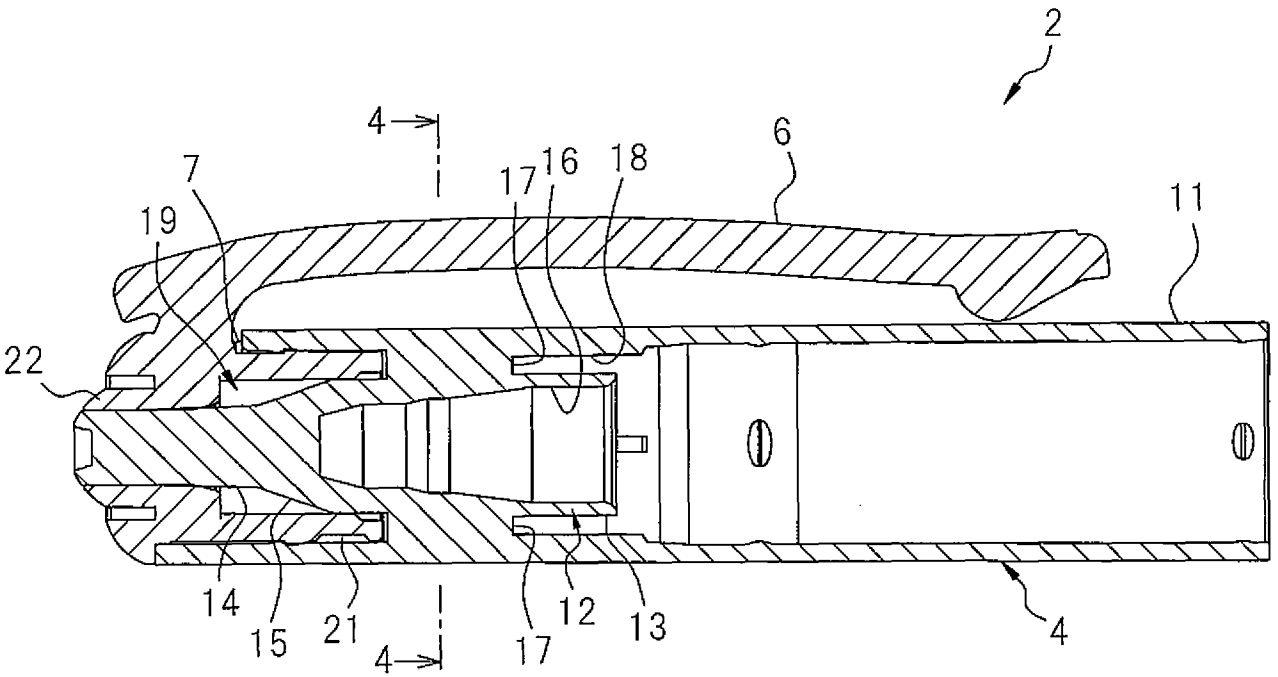
FIG. 3 is a vertical cross-sectional view which schematically shows the constitution of a cap for a writing instrument according to a first embodiment of the present invention.

FIG. 3 is a partial enlarged vertical cross-sectional view of a cap 2. As shown in FIG. 3, the cylinder 11 is formed from a cylindrically shaped hollow member which is open at its both ends. The mount 12 is arranged inside of the cylinder 11 near the front end of the cylinder 11. The outside circumferential surface of the mount 12 is arranged separated from the inside circumferential surface of the cylinder 11. The mount 12 has a columnar large diameter part 13 which is arranged at a back end side of the cylinder 11, a columnar small diameter part 14 which is formed to a smaller diameter than the large diameter part 13 and is arranged at a front end side of the cylinder 11, and a taper part 15 which is arranged between a front end of the large diameter part 13 and a back end of the small diameter part 14 and connects the large diameter part 13 and the small diameter part 14. The diameter of the taper part 15 decreases the further from the large diameter part 13 to the small diameter part 14. The large diameter part 13, small diameter part 14, and taper part 15 are integrally formed. At the back end of the large diameter part 13, a holding space 16 is formed for holding the tip of the refill 8 in an air-tight state. The holding space 16 is formed from a closed bottom hole.

Figure 4:
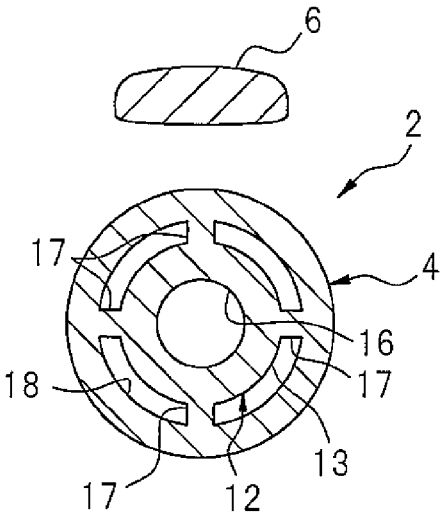
FIG. 4 is a cross-sectional view along a line 4-4 of FIG. 3.

FIG. 4 is an end face view along a line 4-4 of FIG. 3. Referring to FIG. 4 as well, the mount 12 is, for example, connected by four ribs 17 to the inside circumferential surface of the cylinder 11. The ribs 17 are formed integrally with the inside circumferential surface of the cylinder 11 and the outside circumferential surface of the large diameter part 13 of the mount 12. Here, the ribs 17 are arranged around the axial center of the writing instrument 1 at 90° angular intervals at equal intervals from each other. In this way, at the outsides of the ribs 17, a ring-shaped space, that is, an inside air passage 18, is formed between the inside circumferential surface of the cylinder 11 and the outside circumferential surface of the large diameter part 13. The inside air passage 18 enables air to flow between the front end and back end of the cylinder 11. At the same time, the inside air passage 18 is connected to the outside air passage which is formed in the endcap 5 explained later.

On the other hand, as will be clear from FIG. 3, between the outside circumferential surfaces of the large diameter part 13, the small diameter part 14, and the taper part 15 of the mount 12 and the inside circumferential surface of the cylinder 11, a holding space 19 for holding the endcap 5 is formed. The endcap 5 is provided with a for example round tubular shaped endcap outer cylinder 21 which is arranged inside the holding space 19 and a for example round tubular shaped endcap inner cylinder 22 which is arranged inside the endcap outer cylinder 21. The outside circumferential surface of the endcap inner cylinder 22 is arranged separated from the inside circumferential surface of the endcap outer cylinder 21. The endcap 5 is arranged coaxially with the cap body 4. The endcap inner cylinder 22 is arranged near the outside end of the endcap outer cylinder 21. The outside end of the endcap inner cylinder 22 which is exposed to the outside at the front end of the cap body 4 is arranged at the outside from the outside end of the endcap outer cylinder 21 along the axial center of the cap body 4. The endcap outer cylinder 21 engages with the inside circumferential surface of the cylinder 11 at the outside circumferential surface. The endcap inner cylinder 22 engages with the outside circumferential surface of the small diameter part 14 of the mount 12 at the inside circumferential surface. That is, the endcap 5 engages with the cap body 4 at two locations. The inside end of the endcap outer cylinder 21 extends up to the front of the above-mentioned ribs 17. In this way, the inside end of the outer cylinder 21 enters the above-mentioned inside air passage 18.

Figure 5:
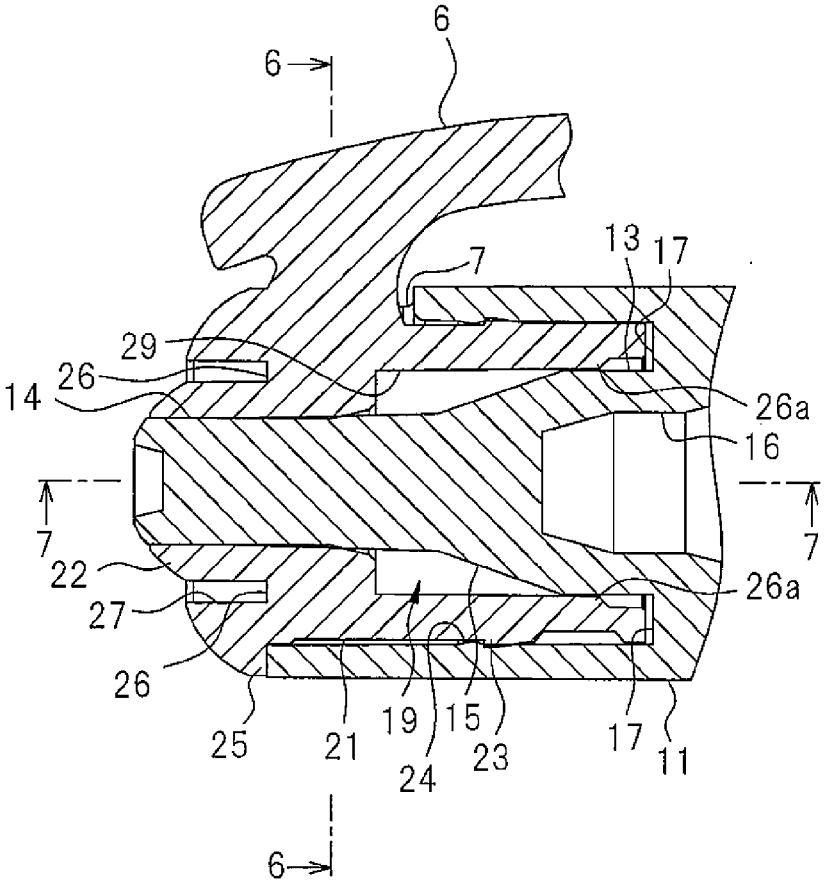
FIG. 5 is a partial enlarged vertical cross-sectional view which schematically shows the constitution of a cap for a writing instrument according to a first embodiment of the present invention.

FIG. 5 is a partial enlarged vertical cross-sectional view of the front end of the cap 2. At the outside circumferential surface of the endcap outer cylinder 21, a ring-shaped endcap side engagement part 23 which extends without interruption about the axial center of the endcap outer cylinder 21 is formed. The endcap side engagement part 23 sticks out from the outside circumferential surface of the endcap outer cylinder 21. The endcap side engagement part 23 is formed at the inside circumferential surface of the cylinder 11 and rides over the ring-shaped cap side engagement part 24 which extends without interruption about the axial center of the cylinder 11 to engage with the cap side engagement part 24. The cap side engagement part 24 sticks out from the inside circumferential surface of the cylinder 11. In this way, the endcap 5 is restricted from detaching from the front end of the cylinder 11. In addition, at the outside end of the endcap outer cylinder 21, an outside flange 25 is formed which extends without interruption about the axial center of the end cap outer cylinder 21. The outside flange 25 contacts the end face of the front end of the cylinder 11. At the outside circumferential surface of the endcap outer cylinder 21, the above-mentioned clip 6 is integrally connected.

Figure 6:
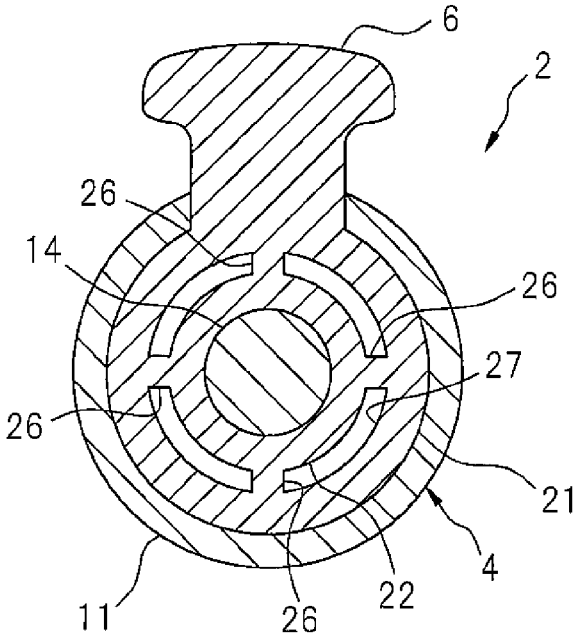
FIG. 6 is a cross-sectional view along a line 6-6 of FIG. 5.

The front end, that is, the outside end, of the small diameter part 14 of the mount 12 sticks out to the outside from the outside end of the endcap inner cylinder 22. The endcap inner cylinder 22 is attached to only the small diameter part 14. The endcap outer cylinder 21 and the endcap inner cylinder 22 are for example connected with each other by four ribs 26. The ribs 26 are formed integrally at the inside circumferential surface of the endcap outer cylinder 21 and the outside circumferential surface of the endcap inner cylinder 22. FIG. 6 is an end face view along the line 6-6 of FIG. 5. Referring to FIG. 6 together, the ribs 26 are arranged about the axial center of the writing instrument 1 at 90° angular intervals at equal intervals from each other. In this way, at the outsides of the ribs 26, a ring-shaped space, that is, outside air passage 27, is formed between the inside circumferential surface of the endcap outer cylinder 21 and the outside circumferential surface of the endcap inner cylinder 22. The outside air passage 27 enables the flow of air between the inside of the cap body 4 and the outside of the endcap 5. Note that, the angular positions of the ribs 26 are, for example, set the same as the angular positions of the ribs 17 about the axis of the cap body 4. However, the angular positions of the ribs 26 may also be offset from the angular positions of the ribs 17.

As clear from FIG. 5, the ribs 26 are provided with extended parts **26*a* which extend along the inside circumferential surface of the endcap outer cylinder 21 toward the inside end of the endcap outer cylinder 21. That is, the extended parts 26*a* extend toward the inside from the inside end of the endcap inner cylinder 22. The inside ends of the extended parts 26*a* are interrupted at positions retracted from the inside end of the endcap outer cylinder 21 to the outside end side of the endcap outer cylinder 21. Parts of the extended parts 26*a* are stopped at the outside circumferential surface of the large diameter part 13. That is, the extended parts 26*a* of the ribs 26 contact the large diameter part 13. Such extended parts 26*a*, as explained later, contribute to improvement of the mounting strength of the endcap 5**.

Figure 7:
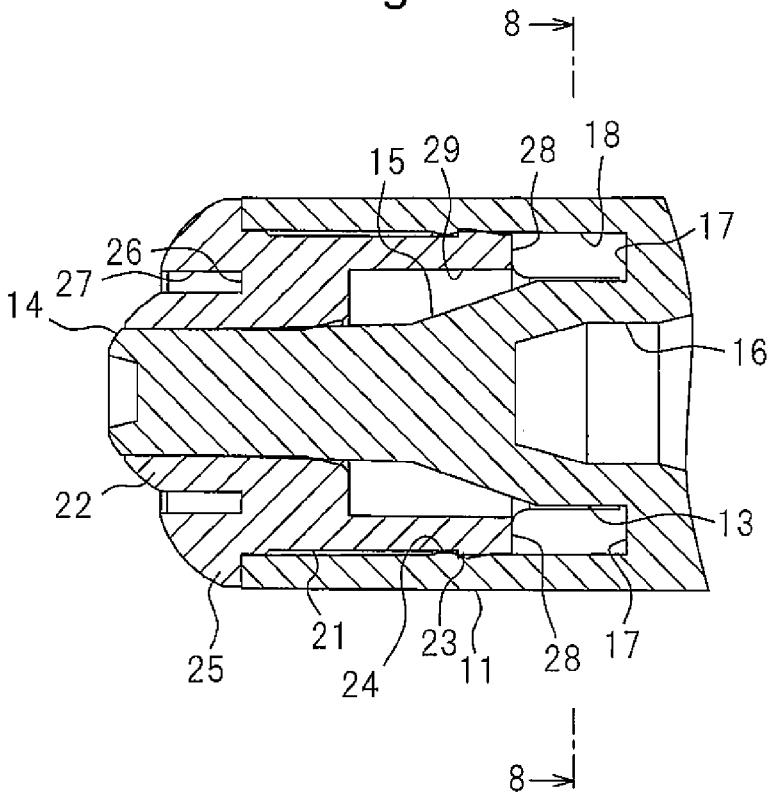
FIG. 7 is a cross-sectional view along a line 7-7 of FIG. 5.
Figure 8:
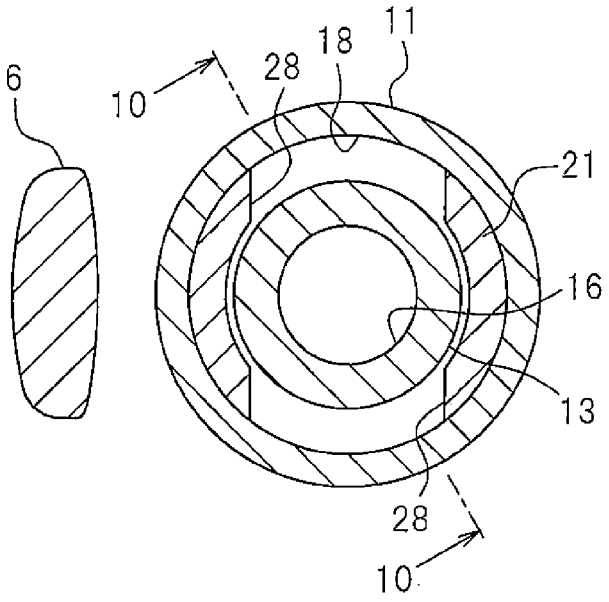
FIG. 8 is a cross-sectional view along a line 8-8 of FIG. 7.
Figure 9:
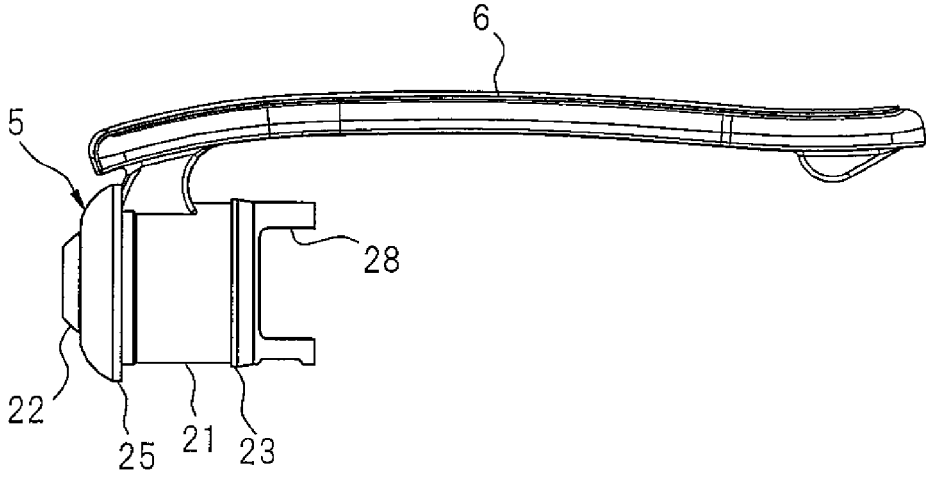
FIG. 9 is a side view which schematically shows the constitution of an endcap for a writing instrument according to a first embodiment of the present invention.

FIG. 7 is a cross-sectional view along the line 7-7 of FIG. 5. As shown in FIG. 7, at the inside end of the endcap outer cylinder 21, cutaway parts 28 are formed about the axial center of the endcap outer cylinder 21 in predetermined angular ranges. Referring to FIG. 8 and FIG. 9 together, at the inside end of the endcap outer cylinder 21, two cutaway parts 28 are formed axially symmetrically about the axial center of the endcap outer cylinder 21. Inside the cutaway parts 28, an inside air passage 18 is secured. The inside ends of the cutaway parts 28 are arranged closer to the outside end of the endcap outer cylinder 21 than the front end of the large diameter part 13. As a result, due to the action of the cutaway parts 28, the inside air passage 18 and the connection path 29 which is formed between the endcap outer cylinder 21, and small diameter part 14 and taper part 15 are connected with each other. The connection path 29 is connected together with the outside air passage 27. As a result, the outside air passage 27 and the inside air passage 18 are connected with each other through the connection path 29.

In such a writing instrument 1, the outside circumferential surface of the endcap outer cylinder 21 engages with the inside circumferential surface of the cylinder 11 and the inside circumferential surface of the endcap inner cylinder 22 engages with the outside circumferential surface of the mount 12. Therefore, for example, if stress acts on the endcap 5 in a direction wherein the axial center of the endcap 5 becomes slanted from the axial center of the cylinder 11, for example, the outside circumferential surface of the endcap outer cylinder 21 and the inside circumferential surface of the endcap inner cylinder 22 will be respectively pressed against the inside circumferential surface of the cylinder 11 and the outside circumferential surface of the mount 12 while pivoting about the front end of the cylinder 11. As a result, slanting of the endcap 5 will be restricted. Therefore, even if not setting the total length or outside diameter of the writing instrument 1 large, the endcap 5 can be attached to the cap body 4 with sufficient mounting strength compared with for example the case of being received at the mount 12 only at the inside circumferential surface of the endcap inner cylinder 22.

In addition, inside the cap body 4, an inside air passage 18 is secured by the cutaway parts 28 which are formed at the inside end of the endcap outer cylinder 21. At the same time, the inside end of the endcap outer cylinder 21 can enter largely into the cylinder 11 at the outside of the cutaway parts 28. For this reason, even when the total length and outside diameter of the writing instrument 1 are limited, the space inside the cylinder 11 can be effectively used. Further, the outside circumferential surface of the endcap outer cylinder 21 contacts the inside circumferential surface of the cylinder 11 over a large area. For example, as clear from FIG. 5, the extended parts 26*a* of the ribs 26 are stopped at the outside circumferential surface of the large diameter part 13. That is, at the parts of the extended parts 26*a*, the thickness of the endcap outer cylinder 21 matches the interval between the inside circumferential surface of the cylinder 11 and the outside circumferential surface of the large diameter part 13, so at the endcap 5, a further larger mounting strength can be secured.

Figure 10:
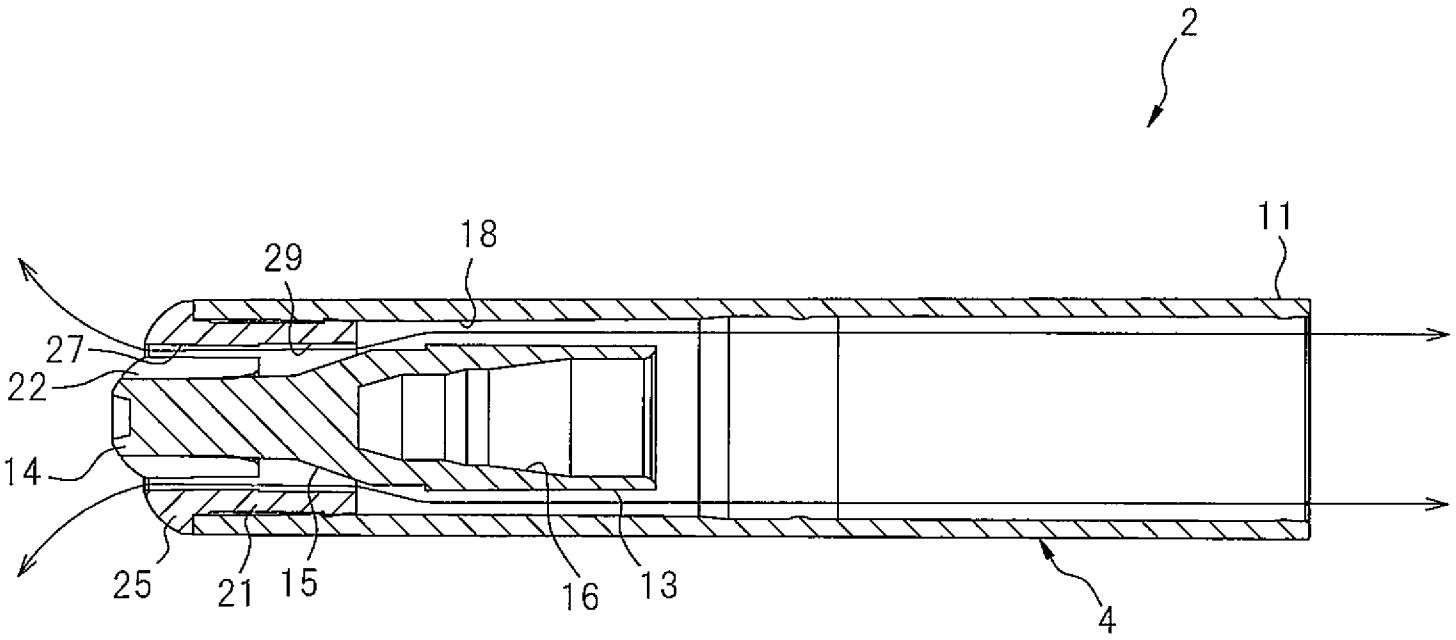
FIG. 10 is another cross-sectional view which schematically shows the constitution of a cap for a writing instrument according to a first embodiment of the present invention.

Furthermore, at the endcap 5, an outside air passage 27 is formed between the inside circumferential surface of the endcap outer cylinder 21 and the outside circumferential surface of the endcap inner cylinder 22. As a result, for example, even if a child mistakenly swallows the cap 2 and it becomes lodged in the trachea of the child, for example, as shown in FIG. 10, air can flow from the front end of the cap 2, that is, from the outside air passage 27, through the connection path 28 and inside air passage 18 to the back end of the cap 2, that is, the back end of the cylinder 11. Conversely, air can flow from the back end of the cap 2, that is, the back end of the cylinder 11, through the inside air passage 18 and connection path 29 to the front end of the cap 2, that is, the outside air passage 27. Therefore, occurrence of accidents leading to suffocation can be reliably prevented.

Further, the mount 12 is formed integrally with the cylinder 11, so the mount 12 can be simply formed to the same color as the cylinder 11. The small diameter part 14 of the mount 12 sticks out to the outside from the outside end of the endcap inner cylinder 22, so the writing instrument 1 can be given a design feature. Further, a user can see the mount 12 at the front end of the cap 2. Therefore, for example, when the ink which is filled in the refill 8 and the cylinder 11 and mount 12 are formed from the same color, the user can confirm the color type of the writing instrument 1 even if viewing the writing instrument 1 from only the front end of the cap 2. Further, if a clip 6 of the same color type as the color type of the writing instrument 1 is integrally formed, the user can confirm the color type of the writing instrument by the clip 6 as well. Further, the mount 12 is formed integrally with the cylinder 11, so in the writing instrument 1, an increase in the number of parts can be avoided.

Next, referring to FIGS. 11 to 21, a second embodiment of the present invention will be explained.

Figure 11:
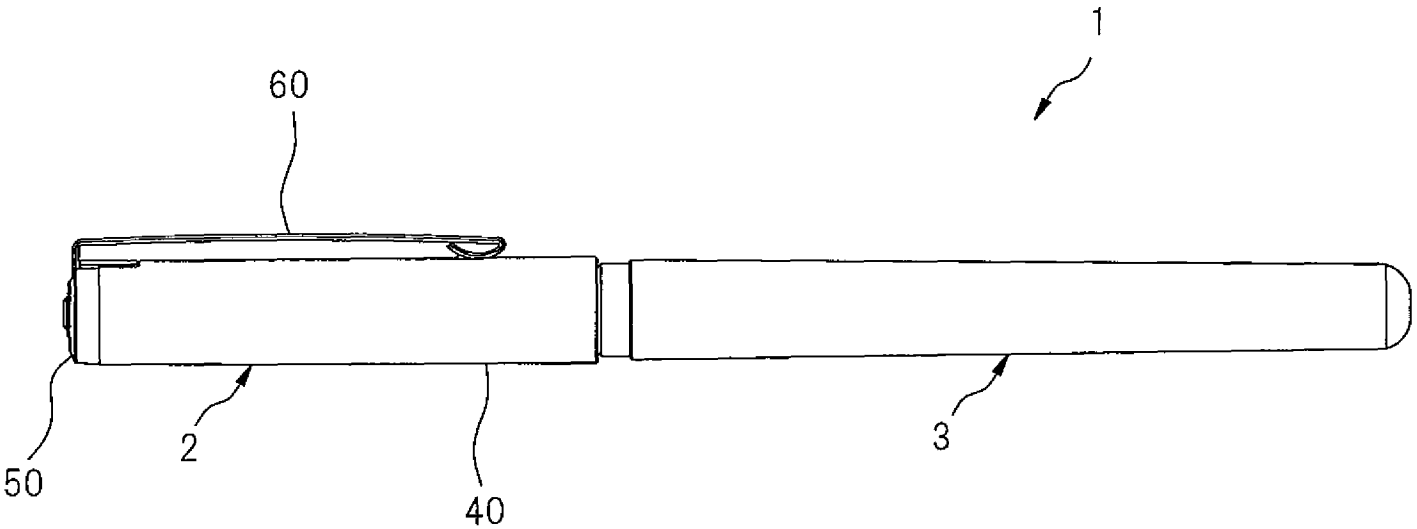
FIG. 11 is a side view which schematically shows the constitution of a writing instrument according to a second embodiment of the present invention.

FIG. 11 is a side view which schematically shows the constitution of the writing instrument 1 according to the second embodiment of the present invention. The writing instrument 1 is, for example, a water-based ink ball point pen. The writing instrument 1 is provided with a cap 2 and a writing instrument body 3 which is inserted from the back end of the cap 2 to be attached to the cap 2. The cap 2 is provided with a cap body 40 which receives a front end part of the writing instrument body 3 at its back end, an endcap 50 which is fastened by insertion into the front end of the cap body 40, and a clip 60 which is fastened by one end part being inserted into the endcap 50.

Figure 12:
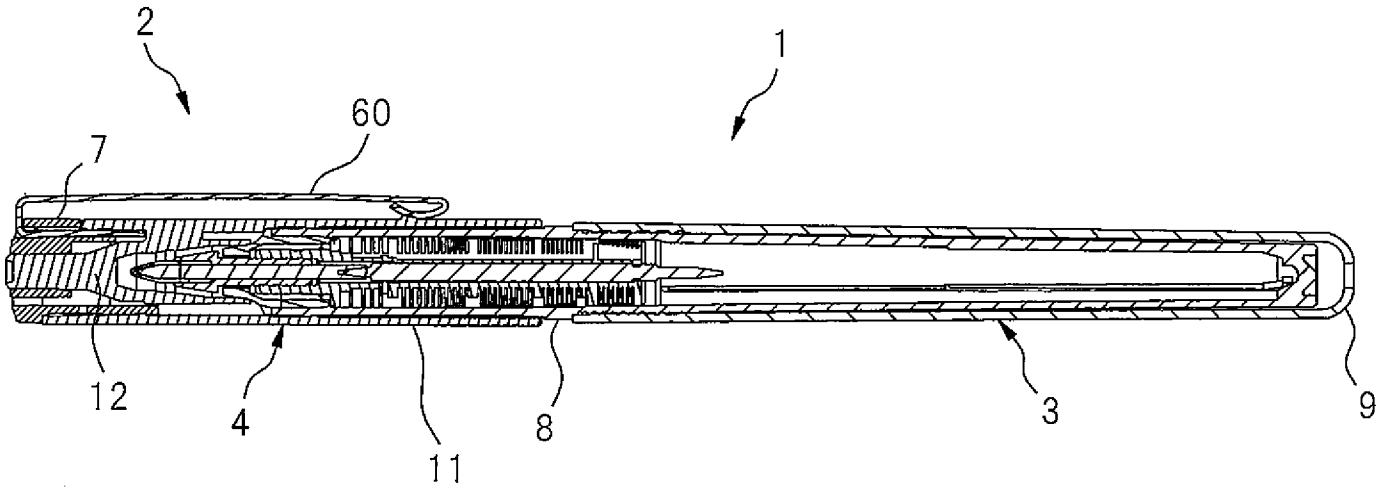
FIG. 12 is a vertical cross-sectional view which schematically shows the constitution of a writing instrument according to a second embodiment of the present invention.

FIG. 12 is a vertical cross-sectional view along an imaginary plane which includes an axial center of the writing instrument 1. The writing instrument body 3 is provided with a refill 8 which holds ink and has a tip at its front end and a back shaft 9 which receives the back end part of the refill 8 to be attached to the refill 8. The refill 8 is filled with water-based ink. On the other hand, the cap body 40 of the cap 2 is provided with a round tubular shaped cylinder 11 and a mount 12 which is arranged inside of the cylinder 11 and is connected to the cylinder 11. The cylinder 11 and the mount 12 are arranged coaxially with each other. The cylinder 11 receives the front end part of the refill 8 at its back end and receives the endcap 50 and clip 60 at its front end.

Below, the second embodiment will be explained in further detail, but explanations of features similar to the first embodiment will be omitted.

In the present embodiment, the clip 60 is a separate member from the endcap 50 and is formed from a material, that is, metal, different from the endcap 50. In this case, the clip 60 is easily produced by pressing from a single sheet of metal. By being formed from a metal, the clip 60 is increased in strength and the writing instrument 1 can be given a design feature. However, the clip 60 may also be formed from a resin material the same or separate from the endcap 50.

Figure 13:
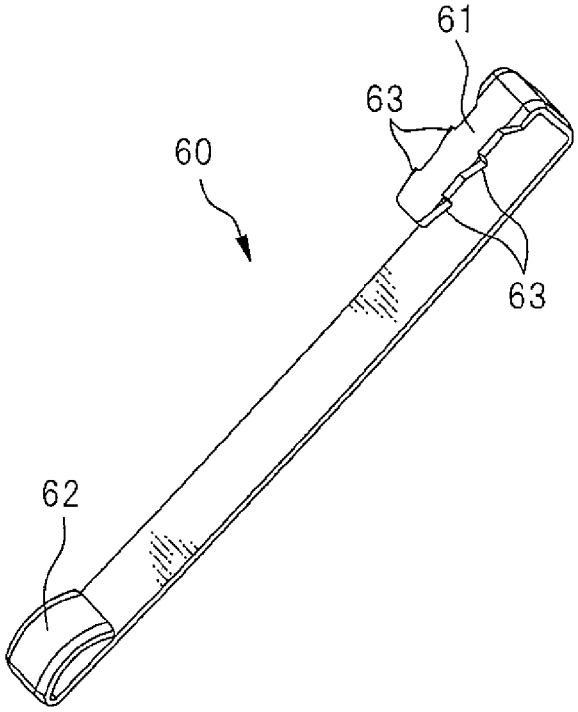
FIG. 13 is a perspective view of a clip according to a second embodiment of the present invention.
Figure 14:
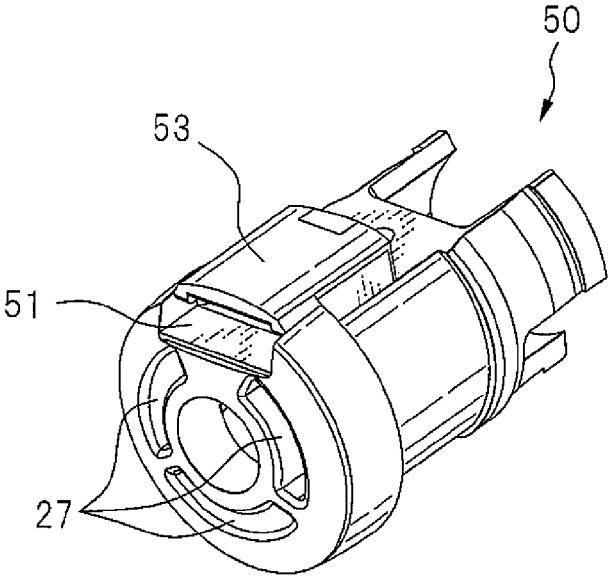
FIG. 14 is a perspective view of an endcap according to a second embodiment of the present invention.
Figure 15:
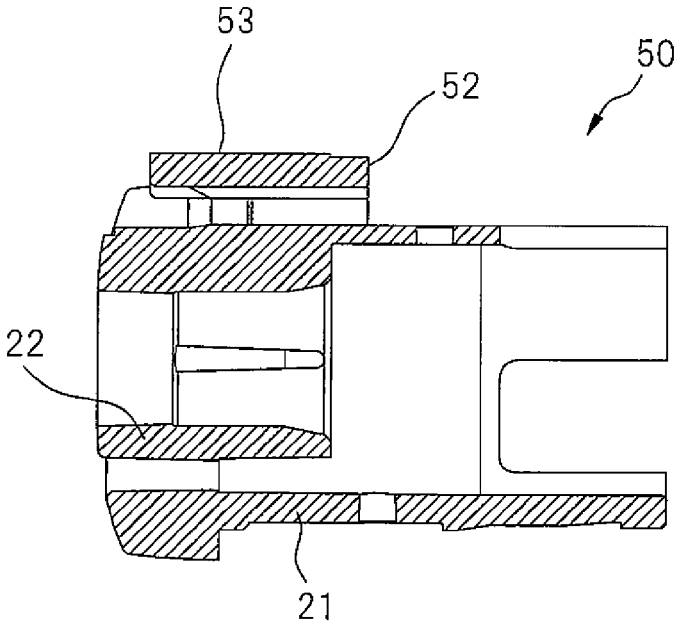
FIG. 15 is a side cross-sectional view of an endcap according to a second embodiment of the present invention.
Figure 16:
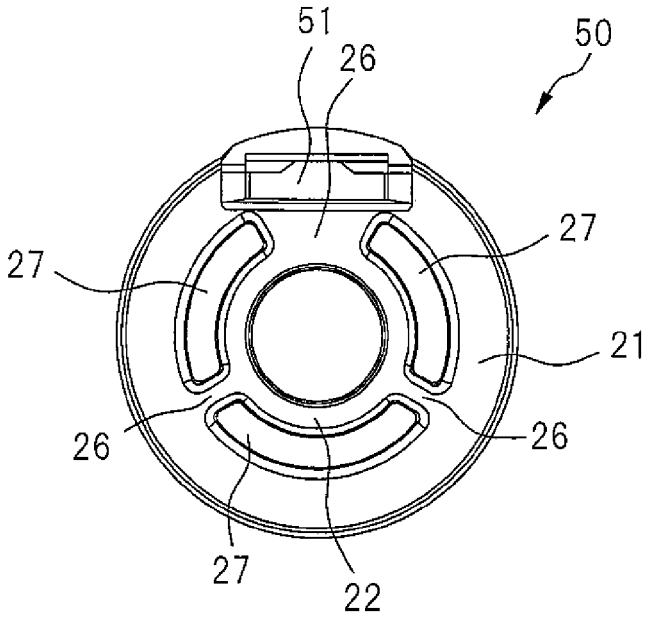
FIG. 16 is a top view of an endcap according to a second embodiment of the present invention.
Figure 17:
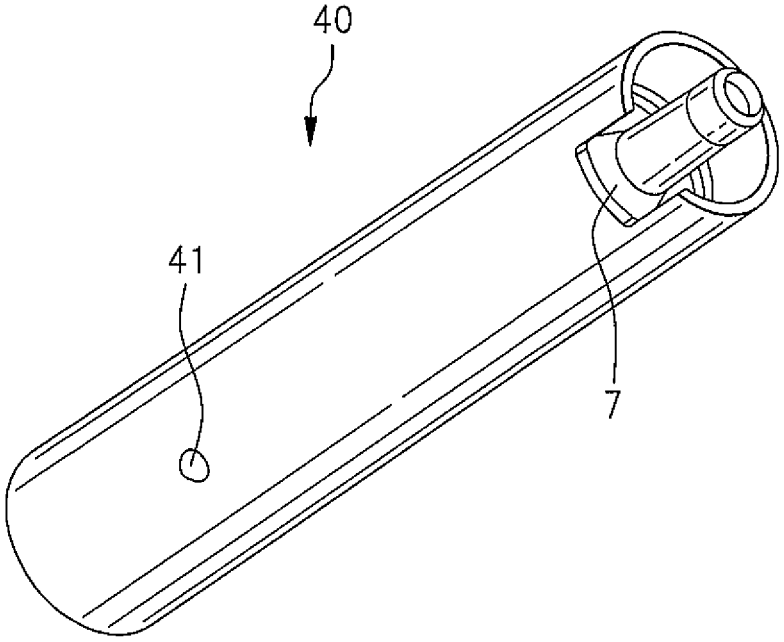
FIG. 17 is a perspective view of a cap body according to a second embodiment of the present invention.
Figure 18:
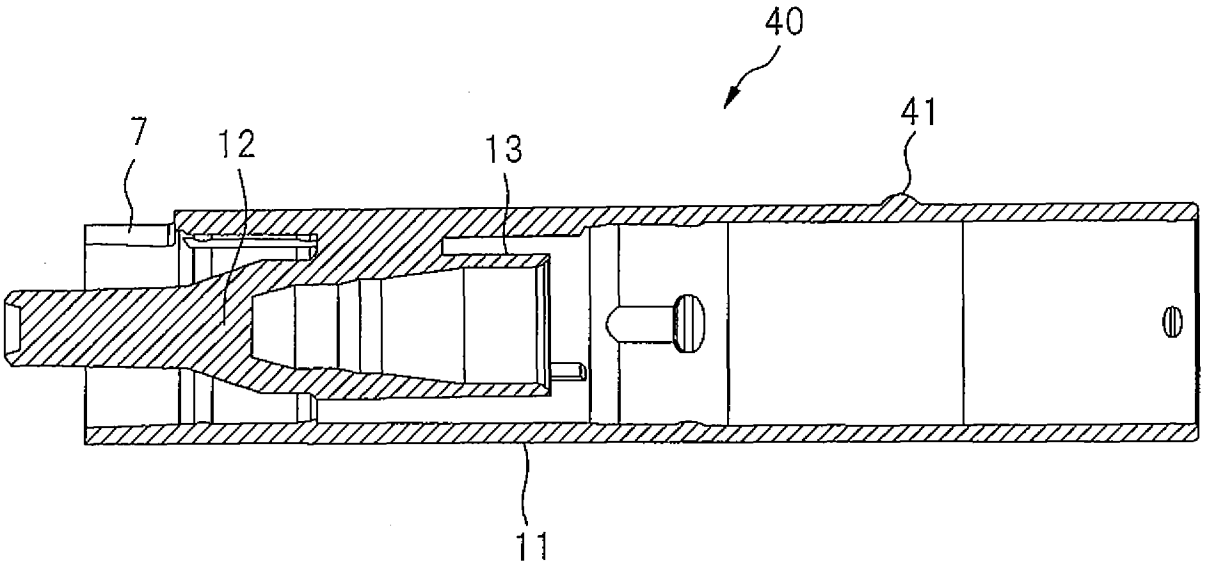
FIG. 18 is a side cross-sectional view of a cap body according to a second embodiment of the present invention.
Figure 19:
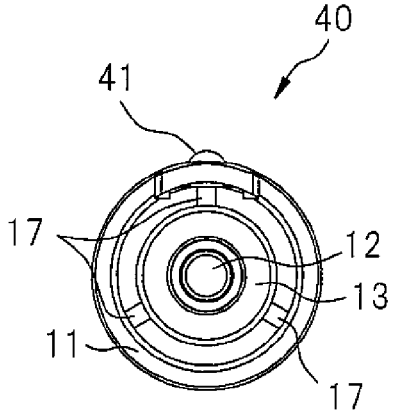
FIG. 19 is a top view of a cap body according to a second embodiment of the present invention.

FIG. 13 is a perspective view of a clip 60 according to the present embodiment. FIGS. 14 to 16 are respectively a perspective view, side cross-sectional view, and top view of an endcap 50 according to the present embodiment. FIGS. 17 to 19 are respectively a perspective view, side cross-sectional view, and top view of a cap body 40 according to the present embodiment. The clip 60 has an insertion end part 61 which is bent substantially perpendicularly two times and an arc shaped end part 62 which is bent into an arc shape. The insertion end part 61 is press-fit into a through hole 51 which is formed in the front end of the endcap 50 to be engaged with the inside circumferential surface of the cylinder 11 of the cap body 40. Further, the insertion end part 61 has four projecting parts 63 which project out in the width direction. The arc shaped end part 62 contacts a projection 41 which is provided on the outside circumferential surface of the cap body 40. The projection 41 of the cap body 40 has the function of preventing the cap body 40 from breaking by contact with the clip 60.

In the present embodiment, the endcap outer cylinder 21 and the endcap inner cylinder 22 of the endcap 50 are mutually connected by three ribs 26. The ribs 26 are integrally formed at the inside circumferential surface of the endcap outer cylinder 21 and the outside circumferential surface of the endcap inner cylinder 22. The ribs 26 are arranged about the axial center of the writing instrument 1 at 120° angular intervals at equal intervals from each other. The rib 26 near the through hole 51 has a thicker width in the circumferential direction than the other ribs 26 so that the outside air passage 27 and through hole 51 are formed. Similarly, the mount 12 of the cap body 40 is connected by three ribs 17 to the inside circumferential surface of the cylinder 11. The ribs 17 are integrally formed at the inside circumferential surface of the cylinder 11 and the outside circumferential surface of the large diameter part 13 of the mount 12. The ribs 17 are arranged about the axial center of the writing instrument 1 at 120° angular intervals at equal intervals from each other. The angular positions of the ribs 17 are set so that when the endcap 50 is fastened to the cap body 40, they become the same as the angular positions of the ribs 26 of the endcap 50 about the axial center of the cap body 40. Further, the three ribs 17 have equal widths. However, the numbers and angular intervals of the ribs 26 and 17 are not limited to three and 120°. The angular positions of the ribs 17 and the angular positions of the ribs 26 may also be offset.

Next, the method of assembly of the clip 60, the endcap 50, and the cap body 40 will be explained.

Figure 20:
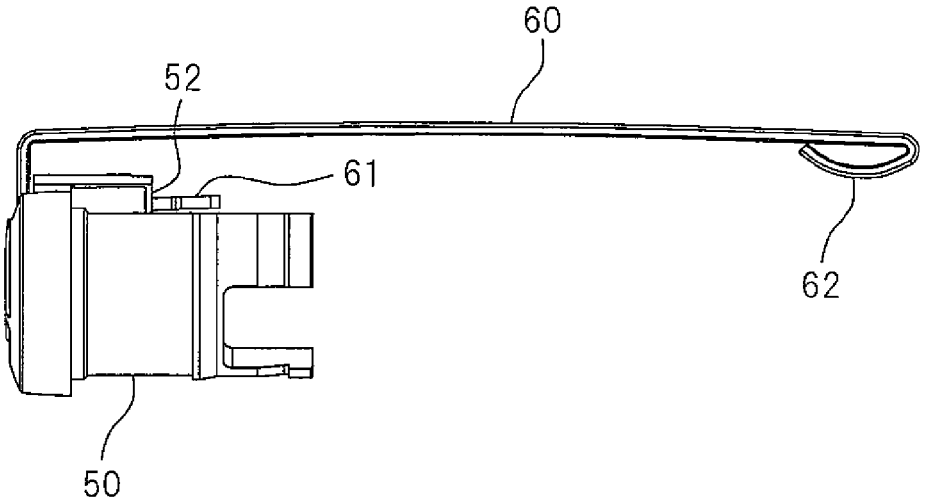
FIG. 20 is a side view of a clip and endcap according to a second embodiment of the present invention.

As shown in FIG. 20, first, the insertion end part 61 of the clip 60 is press-fit into the through hole 51 of the endcap 50 whereby the clip 60 is fastened to the endcap 50. After fastening, even if force is applied to the clip 60 in a direction wherein the insertion end part 61 would detach from the through hole 51, since the horizontal widths of the two projecting parts 63 (see FIG. 13) at the front end side of the insertion end part 61 are greater than the horizontal width of the through hole 51, these two projecting parts 63 will engage with the surroundings 52 of the through hole 51 so detachment of the clip 60 from the endcap 50 will be prevented.

Figure 21:
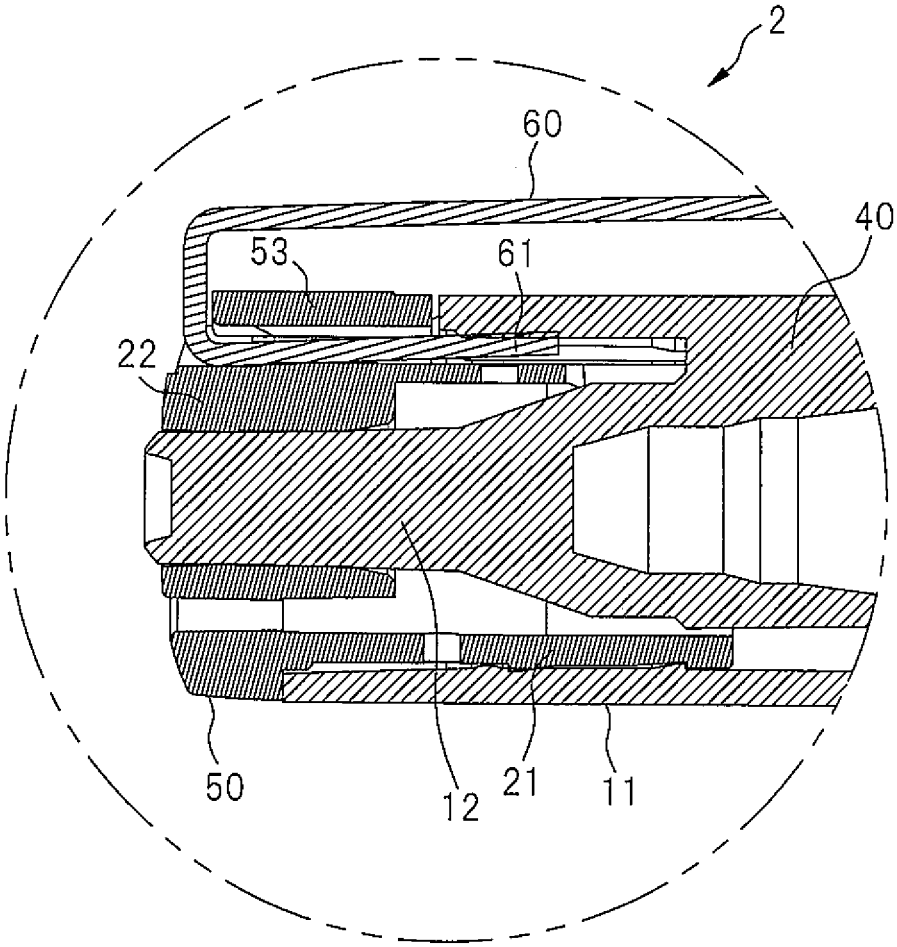
FIG. 21 is an enlarged vertical cross-sectional view of a front end part of a cap according to a second embodiment of the present invention.

Next, the endcap 50 which is provided with the clip 60 is fastened by insertion into the front end of the cap body 40 in a state with the top end part 53 of the endcap 50 (see FIGS. 14 and 15) aligned with the cutaway part 7 of the cap body 40. FIG. 21 is an enlarged vertical cross-sectional view of a cap 2 according to the present embodiment. As shown in FIG. 21, if the endcap 50 provided with the clip 60 is inserted into the front end of the cap body 40, the outside circumferential surface of the endcap outer cylinder 21 will engage with the inside circumferential surface of the cylinder 11 and the inside circumferential surface of the endcap inner cylinder 22 will engage with the outside circumferential surface of the mount 12. Further, the insertion end part 61 of the clip 60 which sticks out from the through hole 51 of the endcap 50 will engage with the inside circumferential surface of the cylinder 11.

Therefore, for example, if stress acts on the endcap 50 in a direction wherein the axial center of the endcap 50 becomes slanted from the axial center of the cylinder 11, the outside circumferential surface of the endcap outer cylinder 21 and the insertion end 61 of the clip 60, and the inside circumferential surface of the endcap inner cylinder 22 will be respectively pressed against the inside circumferential surface of the cylinder 11 and the outside circumferential surface of the mount 12 while pivoting about the front end of the cylinder 11. As a result, slanting of the endcap 50 and clip 60 will be restricted. Therefore, even if not setting the total length or outside diameter of the writing instrument 1 large, the endcap 50 and clip 60 can be attached to the cap body 40 with sufficient mounting strength compared with for example the case of being received at the mount 12 only at the inside circumferential surface of the endcap inner cylinder 22.

Note that, in the above assembly method, first, the endcap 50 may be fastened by insertion into the front end of the cap body 40, then the insertion end part 61 of the clip 60 may be press-fit into the through hole 51 of the endcap 50 to fasten the clip 60 to the endcap 50 and cap body 40.

The present invention can also be applied to writing instrument 1 which does not have a cap 2 instead of the above such writing instrument 1. In this case, the back shaft 9 is formed with structures similar to the above-mentioned cylinder 11 and mount 12. The endcap 5, 50 is attached to the open end formed at the back end of the back shaft 9, that is, the cylinder 11. The endcap 5 may be provided with the above-mentioned clip 6, 60 as well. In addition, the writing instrument 1 according to the present invention also includes, in addition to the above-mentioned water-based ink ball point pen, for example, a gel ink ball point pen, oil-based ink ball point pen, felt tip pen, or other writing instrument needless to say.

The present invention was explained based on specific embodiments, but a person skilled in the art could make various changes, corrections, etc. without departing from the claims and concept of the present invention.

REFERENCE SIGNS LIST

1 writing instrument
2 cap
3 writing instrument body
4, 40 body (cap body)
5, 50 endcap
6, 60 clip
11 cylinder
12 mount
18 air passage (inside air passage)
19 holding space
21 endcap outer cylinder
22 endcap inner cylinder
27 ring-shaped space (outside air passage)
28 cutaway part

The invention claimed is:

1. A writing instrument which is provided with an endcap which is provided with an endcap outer cylinder and an endcap inner cylinder, an inside circumferential surface of said endcap outer cylinder being arranged separate from an outside circumferential surface of said endcap inner cylinder whereby a ring-shaped space is formed between said inside circumferential surface of the endcap outer cylinder and the outside circumferential surface of said endcap inner cylinder, and a body which is provided with a cylinder and a tubular mount which is formed inside of said cylinder and which is connected to said cylinder and which forms a holding space for holding the endcap between an inside circumferential surface of said cylinder and an outside circumferential surface of said mount, wherein said endcap is inserted into said holding space of said body, an outside circumferential surface of said endcap outer cylinder and the inside circumferential surface of said cylinder are fit together, and an inside circumferential surface of said endcap inner cylinder and the outside circumferential surface of said mount are fit together, whereby said endcap is fastened to said body and air can circulate between an inside of said body and an outside of said endcap through said ring-shaped space which is formed between the inside circumferential surface of said endcap outer cylinder and the outside circumferential surface of said endcap inner cylinder.

2. The writing instrument according to claim 1 wherein said mount sticks out to the outside from an outer end of said endcap inner cylinder.

3. The writing instrument according to claim 2, wherein said body is provided with a cap body which has said cylinder and said mount and a writing instrument body is attached to said cap body.

4. The writing instrument according to claim 1, further provided with a cutaway part which is formed at an inside end of said endcap outer cylinder and forms an air passage between the inside circumferential surface of said cylinder and the outside circumferential surface of said mount.

5. The writing instrument according to claim 4, wherein said body is provided with a cap body which has said cylinder and said mount and a writing instrument body is attached to said cap body.

6. The writing instrument according to claim 1 wherein said mount sticks out to the outside from an outer end of said endcap inner cylinder and the instrument is further provided with a cutaway part which is formed at an inside end of said endcap outer cylinder and forms an air passage between the inside circumferential surface of said cylinder and the outside circumferential surface of said mount.

7. The writing instrument according to claim 6, wherein said body is provided with a cap body which has said cylinder and said mount and a writing instrument body is attached to said cap body.

8. The writing instrument according to claim 1, wherein said body is provided with a cap body which has said cylinder and said mount and a writing instrument body is attached to said cap body.

9. A cap for a writing instrument provided with:

an endcap which is provided with an endcap outer cylinder and an endcap inner cylinder, an inside circumferential surface of said endcap outer cylinder being arranged separate from an outside circumferential surface of said endcap inner cylinder whereby a ring-shaped space is formed between said inside circumferential surface of the endcap outer cylinder and the outside circumferential surface of said endcap inner cylinder, and a cap body which is provided with a cylinder and a tubular mount which is formed inside of said cylinder and which is connected to said cylinder and which forms a holding space for holding the endcap between an inside circumferential surface of said cylinder and an outside circumferential surface of said mount, wherein said endcap is inserted into said holding space of said cap body, an outside circumferential surface of said endcap outer cylinder and the inside circumferential surface of said cylinder are fit together, and an inside circumferential surface of said endcap inner cylinder and the outside circumferential surface of said mount are fit together, whereby said endcap is fastened to said cap body and air can circulate between an inside of said cap body and an outside of said endcap through said ring-shaped space which is formed between the inside circumferential surface of said endcap outer cylinder and the outside circumferential surface of said endcap inner cylinder.

* * * * *